US005171504A

United States Patent [19]

Cuculo et al.

[11] Patent Number: 5,171,504

[45] Date of Patent: Dec. 15, 1992

[54] PROCESS FOR PRODUCING HIGH STRENGTH, HIGH MODULUS THERMOPLASTIC FIBERS

[75] Inventors: John A. Cuculo; Paul A. Tucker, both of Raleigh, N.C.; Chon-Yie Lin, Chester, Va.; Ferdinand Lundberg, Raleigh, N.C.

[73] Assignee: North Carolina State University, Raleigh, N.C.

[21] Appl. No.: 676,641

[22] Filed: Mar. 28, 1991

[51] Int. Cl.[5] ..... D01D 5/084; D01D 5/092

[52] U.S. Cl. ..... 264/178 F; 264/181; 264/210.4; 264/210.8

[58] Field of Search ..... 264/210.8, 181, 178 F, 264/210.4

[56] References Cited

U.S. PATENT DOCUMENTS

| | | | |
|---|---|---|---|
| 3,002,804 | 10/1961 | Kilian | 264/181 |
| 3,053,611 | 9/1962 | Griehl | 264/210.8 |
| 3,086,275 | 4/1963 | Pritchard | 264/289.6 |
| 3,221,088 | 11/1965 | Martin | 264/210.8 |
| 3,361,859 | 1/1968 | Cenzato | 264/211.17 |
| 4,909,976 | 3/1990 | Cuculo et al. | 264/211.17 |

FOREIGN PATENT DOCUMENTS

| | | | |
|---|---|---|---|
| 670932 | 9/1963 | Canada | 264/181 |

*Primary Examiner*—James Lowe

*Attorney, Agent, or Firm*—Bell, Seltzer, Park & Gibson

[57] ABSTRACT

The invention provides improved thermoplastic high strength, highly oriented fibers and a process for producing the fibers by melt spinning a thermoplastic polymer to form a threadline, preferably passing the threadline through a thermal conditioning zone and then quenching the threadline. The quenched threadline is passed through a hydraulic drag bath maintained at a temperature of greater than the glass transition temperature of the polymer which substantially increases the threadline stress and results in drawing of the threadline. The threadline is withdrawn from the drag bath at a withdrawal rate of at least 3,000 meters per minute.

32 Claims, 9 Drawing Sheets

—o—110°C (28cm) with TCZ = 250°C
—□—110°C (28cm) with no TCZ
—△—95°C (32cm) with TCZ = 250°C
—◇—95°C (32cm) with no TCZ —o—110°C (28cm) with TCZ = 250°C
—□—110°C (28cm) with no TCZ
—△—95°C (32cm) with TCZ = 250°C
—◇—95°C (32cm) with no TCZ —○— 5500 m/min and HDB (25°C & 8cm) and no TCZ
—□— 5000m/min HDB (95°C & 32cm) and TCZ = 250°C
—△— 4250m/min HDB (110°C & 28cm) AND TCZ = 250°C —○— 5500 m/min and HDB (25°C & 8cm) and no TCZ
—□— 5000m/min HDB (95°C & 32cm) and TCZ = 250°C
—△— 4250m/min HDB (110°C & 28cm) AND TCZ = 250°C

PROCESS FOR PRODUCING HIGH STRENGTH, HIGH MODULUS THERMOPLASTIC FIBERS

FIELD OF THE INVENTION

The invention relates to the melt spinning of thermoplastic polymers. More particularly, the invention relates to a high speed melt spinning process which employs controlled threadline dynamics to provide high strength, highly oriented thermoplastic filaments. The invention also relates to improved thermoplastic high strength, highly oriented and high modulus industrial and textile fibers.

BACKGROUND OF THE INVENTION

In the traditional thermoplastic fiber melt spinning process, fibers of, for example poly(ethylene terephthalate) (PET), are spun and then subjected to a subsequent drawing process to impart desirable tensile properties to the fibers. The traditional spin-draw process, whether carried out in a two-step or as a continuous process, is energy and cost intensive due to the complexity of the operation and to the equipment involved. Nevertheless, high strength industrial fibers such as PET and nylon find widespread use in commerce and have resulted in the availability of numerous improved products including bias and radial tires, sewing thread, industrial fabric and the like.

Because of the widespread commercial use of industrial fibers, considerable effort has been directed toward providing fibers of improved properties. As a result of decades of research and development, there have been numerous processes proposed for producing high tenacity, high modulus fibers. However, many of these techniques have proven to be laboratory curiosities, limited to small scale batch procedures. Despite intensive effort, the properties of commercial fibers are still several orders of magnitude below theoretically possible values. For example, PET polymer has been reported to have a potential theoretical tenacity of 232 g/d, T. Ohta; *Polym. Eng. Sci.* 23, 697 (1983). But despite the decades of substantial research and development, current industrial PET yarns have a tenacity of about 9 g/d, a value far below the theoretical value.

During the past decade, efforts have been focused on high speed spinning of fibers. In Frankfort and Knox, U.S. Pat. No. 4,134,882, oriented crystalline PET fibers possessing good thermal stability and good dyeing properties were spun in a one-step process at take-up speeds of up to 7,000 m/min. Numerous other researchers have attempted to adapt the benefits of high speed melt spinning to produce various synthetic fibers including PET, polyamide 6, polyamide 66, and polyolefins such as polypropylene.

The high-speed melt spinning studies have resulted in the general recognition that concentrated deformation in the threadline, appearing as a neck like deformation, is generally correlated with the cooling rate and to the stress in the threadline. The stress is of primary importance since it is the main source of molecular orientation and of the subsequent structure development. The increased stress also results in a stress induced fiber crystallization. Although relatively high levels of stress have been obtained in fiber formation via ultra high-speed spinning employing spinning speeds of up to, for example, 12,000 m/min., fibers thus produced still possess poor mechanical properties due to insufficient time for the completion of structure development, to the development of a severe radial inhomogeneity of fiber structure and to the formation of voids in the sheath portion of the fiber.

The use of liquids for an in-line coupled spin-draw process was proposed nearly three decades ago in U.S. Pat. No. 3,002,804 to Kilian. In this process, melt spun filaments were quenched by cooling air or by a liquid drag bath to at least 50° C., and preferably 100° C., below the melting point of the filaments prior to or concurrent with the entry of the filaments into the liquid drag bath. The liquid drag bath was positioned at a distance of up to twenty-four inches and preferably four to six inches, below the face of the spinneret. The liquid drag bath was provided by a container having a restricted orifice in its bottom wall or by a long tube positioned vertically in the path of the filament. The liquid drag bath was used at ambient temperature or heated to a temperature of 80°-90° C. up to 94° C. The maximum tenacity of filaments reported was 7.7 g/d employing a liquid drag bath of 10 feet in length positioned 4 inches below the face of the spinneret using a wind-up speed of 3,000 yards per minute (2,750 meters per minute).

A process similar to the Kilian process was proposed at about the same time in Canadian Patent No. 670,932 to Thompson and Marshall (1963). In the case of this process, a water bath at a temperature above the second order transition temperature of the spun filaments was positioned at a location near the spinneret such that the filaments entered the high temperature water without being substantially heated or cooled. The filament was passed over a guide at the bottom of the bath and was taken back to the surface of the bath over another guide and a wind-up bobbin. The maximum wind-up speed was maintained preferably below 3,000 yards per minute (2,750 meter per minute). The maximum tenacity of filaments thus produced was 3.4 g/d at a path of 270 cm. in water bath at 88° C.

A liquid quenching process was proposed in U.S. Pat. No. 4,932,662 to Kurita et al. In this process, a liquid quenching tube maintained at a temperature of less than or equal to 50° C. was positioned at a distance from the spinneret where the filament was not solidified. A fast quenching effect occurred in the filament to suppress crystallization. In addition to the quenching apparatus, a draw-heating zone was added to the threadline subsequent to the quenching step. In this process, filaments used for the subsequent drawing and heat treatment had a high differential in molecular orientation between the yarn surface and center, ca. $5\times10^{-3}$ and preferably $10\times10^{-3}$. After the drawing and heat treatment, the spun filaments also exhibited a substantial radial variation of birefringence ranging from $7.0\times10^{-3}$ to $14\times10^{-3}$. The maximum tenacity of filaments was reported to be 11.31 g/d at 25 cm. of the quenching tube and with a 1.31 draw ratio using steam at 245° C. between a set of draw rolls.

U.S. Pat. No. 4,909,976 to Cuculo et al. discloses an advantageous process for optimizing fiber structure (orientation and crystallization) development along the threadline during high speed melt spinning. This process employs a zone cooling and zone heating technique to alter the temperature profile of the moving threadline to enhance structure formation. Take-up stress remained almost unchanged as compared with that of conventional melt spinning.

Despite the decades of intensive research, commercial processes for producing high strength, high modulus fibers from commonly available polymers such as PET are limited to in-line or two-step spin draw processes using mechanical drawing apparatus. Moreover, fibers possessing desirable properties of high strength, high modulus, high orientation and which are of high radial uniformity are nevertheless still far below potentially obtainably values.

SUMMARY OF THE INVENTION

This invention provides improved high strength, high modulus, high birefringence thermoplastic fibers which have a high radial uniformity. Polyester fibers of the invention can have high tenacity values up to and exceeding 9 grams per denier; initial modulus values up to and above 100 grams per denier; birefringence values of greater than about 0.18, up to and approaching the theoretical maximum birefringence and can also have a high radial uniformity of properties such as density and birefringence. The invention also provides an improved in-line process for providing high strength, high modulus and highly oriented and uniform fibers which does not require mechanical drawing apparatus and associated heated pins, heated rolls or steam heating zones as required by prior art processes.

The process provided according to this invention includes the steps of melt spinning a thermoplastic polymer to form a threadline and thereafter quenching the threadline to a temperature of less than about 100° C., preferably to a temperature of less than about 75° C., for example 40°-60° C. The quenched threadline is passed through a hydraulic drag bath which is maintained at a temperature greater than the glass transition temperature of the thermoplastic polymer, preferably greater than about 100° C., resulting in a substantial increase in the threadline stress and in drawing of the threadline. The threadline is then withdrawn from the hydraulic drag bath at a withdrawal rate of 3,000 meter per minute or greater.

In one preferred embodiment of the invention, the process of the invention is conducted using a thermal conditioning zone between the melt spinning zone and the quench zone. The thermal conditioning zone maintains the threadline at an increased temperature prior to quench in order to improve the development of structure in the threadline. Thereafter, when the threadline is treated by passage through the hydraulic drag bath, process stability is improved and the resultant fibers exhibit improved characteristics. The use of a thermal conditioning zone to improve development of structure in the threadline prior to the hydraulic drag bath also allows the use of a wider range of temperatures in the hydraulic drag bath while still maintaining process operability.

Advantageously, the hydraulic drag bath employed in the process of the invention is maintained at a temperature greater than 100° C. up to about 150° C. so that molecular mobility is increased as the threadline passes through the hydraulic drag bath. In this aspect of the invention, the hydraulic drag bath is composed of a liquid having a boiling point substantially higher than that of water, i.e. substantially above about 100° C. The use of a heated hydraulic drag bath having a temperature in the range of 100°-150° C. and preferably in the range of 110°-130° C., improves process operation, allows the use of higher spinning speeds, and results in improved fiber properties.

The process of the invention can be conducted using a wide variety of thermoplastic polymer having either low or high intrinsic viscosity (IV). Advantageously, the process of the invention is conducted in any of its various aspects employing a thermoplastic polymer of a high intrinsic viscosity (IV) such as poly(ethylene terephthalate) having an IV of greater than about 0.8 preferably greater than 0.9. It is also preferred that the threadline be passed across a low friction threadline guide at the bottom of the hydraulic drag bath and that the threadline is introduced into and withdrawn from the top of the hydraulic drag bath. Thus, the need for threadline orifices at the bottom of a hydraulic drag bath which increase the complexity of operation, can be avoided, and in addition, the string-up operation is greatly simplified.

In any of its aspects, the process of the invention is capable of providing fibers for industrial or textile uses which have improved strength in the range of 7-12 grams per denier or higher, high orientation and high uniformity radially. The fibers produced according to the process of this invention can be used with or without further treatments to improve properties. The process of the invention is capable of producing polyester and other thermoplastic fibers at high speeds having extremely high tenacity, modulus and birefringence values, substantially beyond the combination of values exhibited by commercially available high strength industrial polyester fibers. Nevertheless, the process of the invention can be readily employed in a commercial environment while eliminating the need and expense for mechanical drawing rolls and associated heating equipment.

CHARACTERIZATION AND MEASUREMENT METHODS

The spun fiber properties and characteristics, and the threadline tension values referred to in this application were determined as follows.

(a) Polarizing Microscopy. A Nikon polarizing microscope equipped with a Leitz tilting compensator, model E. (20 orders), was used to determine the birefringence of fiber samples. The birefringence average is based on the mean value of five individual fibers.

(b) Density Gradient Column. Fiber density was measured at 23° C. using a density gradient column filled with sodium bromide solution in the density range of 1.335-1.415 g/cm$^3$. The sample preparation and density measurement are in accordance with ASTM standard D1505-68. The weight fraction crystallinity, $X_{c,wt}$, is calculated from the density method by applying the equation:

$$X_{c'wt} = \frac{(\rho - \rho_a^o) \cdot \rho_c^o}{(\rho_c^o - \rho_a^o) \cdot \rho}$$

and the volume fraction crystallinity, $X_{c,vl}$, is calculated from the equation:

$$X_{c'vl} = \frac{(\rho - \rho_a^o)}{(\rho_c^o - \rho_a^o)}$$

where $\rho$ is the density of the fiber, $\rho_c^o$ is the density of the crystalline phase, and $\rho_a^o$ is the density of the amorphous phase. The values of $\rho_c^o$ and $\rho_a^o$ used in the calculation for PET are 1.455 g/cm$^3$ and 1.335 g/cm$^3$, respectively (G. Farrow and J. Bagley, *Textile Res. J.*, 32, 587, 1962).

(c) Wide-Angle X-Ray Scattering (WAXS). A Siemens type-F x-ray diffractometer system equipped with a nickel-filtered Cu $K_{60}$ ($\lambda = 1.5418$ Å) radiation source and a proportional counter was used in the analysis of the crystalline structure of PET samples. The apparent crystalline dimension, $L_{hkl}$, is determined according to the Scherrer equation (P. Scherrer, *Gottingher Nachrichten*, 2, 98, 1918):

$$L_{hkl} = \frac{K\lambda}{\beta\cos\theta}$$

where $\beta$ is the half width of the reflection peak; K is taken to be unity; $\theta$ is the Bragg angle; $\lambda$ is the wavelength of x-ray used. The crystalline orientation factor, $f_c$, is related to $<\cos^2\phi_{c,z}>$ as follows:

$$f_c = \tfrac{1}{2}(21 \cos^2\phi_{c,z}> - 1)$$

where $\phi_{c,z}$ is the angle between the c crystallographic axis and the fiber axis. The value of $<\cos^2\phi_{c,z}>$ is determined from azimuthal intensity measurements on the reflection of $(_{105}-)$ with the following equations (V. B. Gupta and S. Kumar, *J. Polym. Sci., Polym. Phys. Ed.*, 17, 179, 1979).

$$<\cos^2\phi_{\overline{105},z}> = \frac{\int_0^{\pi/2} I(\phi)\sin\phi\cos^2\phi d\phi}{\int_0^{\pi/2} I(\phi)\sin\phi d\phi}$$

$$<\cos^2\phi_{c,z}> = \frac{<\cos^2\phi_{\overline{105},z}>}{\cos^2\alpha}$$

where $I(\phi)$ is the diffraction intensity at the corresponding azimuthal angle $\phi$; $\phi_{105,z}-$ is the angle between $(_{105}-)$ reflection plane normal and the fiber axis; $\alpha$ is the angle between $(_{105}-)$ reflection plane normal and the c crystallographic axis.

The amorphous orientation factor, $f_a$, is determined using the following relationship.

$$\Delta n = \Delta n_c^{\circ} f_c X_{c,vl} + \Delta n_a^{\circ} f_a (1 - X_{c,vl})$$

where $\Delta n$ is the total birefringence of fiber measured by polarizing microscopy; $X_{c,vl}$ is the volume fraction crystallinity from the density method; $\Delta n_c^{\circ}$ and $\Delta n_a^{\circ}$ are the respective intrinsic birefringences of the crystalline and the amorphous regions. The values of $\Delta n_c^{\circ}$ and $\Delta n_a^{\circ}$ are 0.22 and 0.275 (J. H. Dumbleton, *J. Polym. Sci. Ser. A-2*, 6, 795, 1968).

(d) Interference Microscopy. Radial distribution of structure was determined with a Jena interference microscope interfaced to a computer imaging system developed in our laboratory. The radial birefringence and Lorentz density were calculate d, in turn, from the local refractive indices ($n_{\parallel}$ and $n_{\perp}$) parallel and perpendicular, respectively, to the fiber axis by the shell model assumption.

(e) Boil-Off Shrinkage (BOS). Boil-off shrinkage was determined by loading a parallel bundle of unconstrained fibers in boiling water for five minutes in accordance with ASTM D2102-79. The percent shrinkage was calculated as $$BOS = \left(1 - \frac{l}{l_o}\right) \times 100$$

where $l^{\circ}$ is the initial length and l is the final length of the fibers.

(f) Instron Tensile Tester. A table model 1122 Instron Tensile Tester was used to measure tenacity, ultimate elongation, and initial modulus in accordance with ASTM D3822-82. The fiber sample was tested at a gauge length of 25.4 mm and at a constant cross head speed of 20 mm/min. An average of at least five individual tensile determinations was obtained for each sample.

(g) Diameter Measurement. Threadline diameter was measured with a non-contact Zimmer® diameter monitor (model 460 A/2). In principle, this device is based on the amount of light blocked by the fiber object for the determination of the filament diameter. Due to the difficulty of focus, a computer equipped with an analogue and digital converter was used to interface the diameter monitor. A measurement at any position in the threadline was based on the distribution of 1000 readings and the diameter was determined from the most frequent diameter as measured.

(h) Tension Measurement. Threadline tension was obtained with a Rothschild tensiometer positioned in the threadline at the point where the filament had reached its final spinning speed. The tensiometer employed the usual three-point geometric path of the fiber through the unit. When the threadline changes direction over the surface of a tensiometer pin, the centrifugally generated tension opposes the force exerted on the surface due to the tension in the threadline. As a consequence, the measured tension is about $mV^2$ lower than the true tension in the threadline; where m is the mass per unit length of the threadline and V is its velocity. Therefore, the measured tension was thus corrected for the loss due to the centrifugal force.

BRIEF DESCRIPTION OF THE DRAWINGS

In the drawings which form a portion of the original disclosure of the invention.

DETAILED DESCRIPTION OF THE INVENTION

Figure 1:
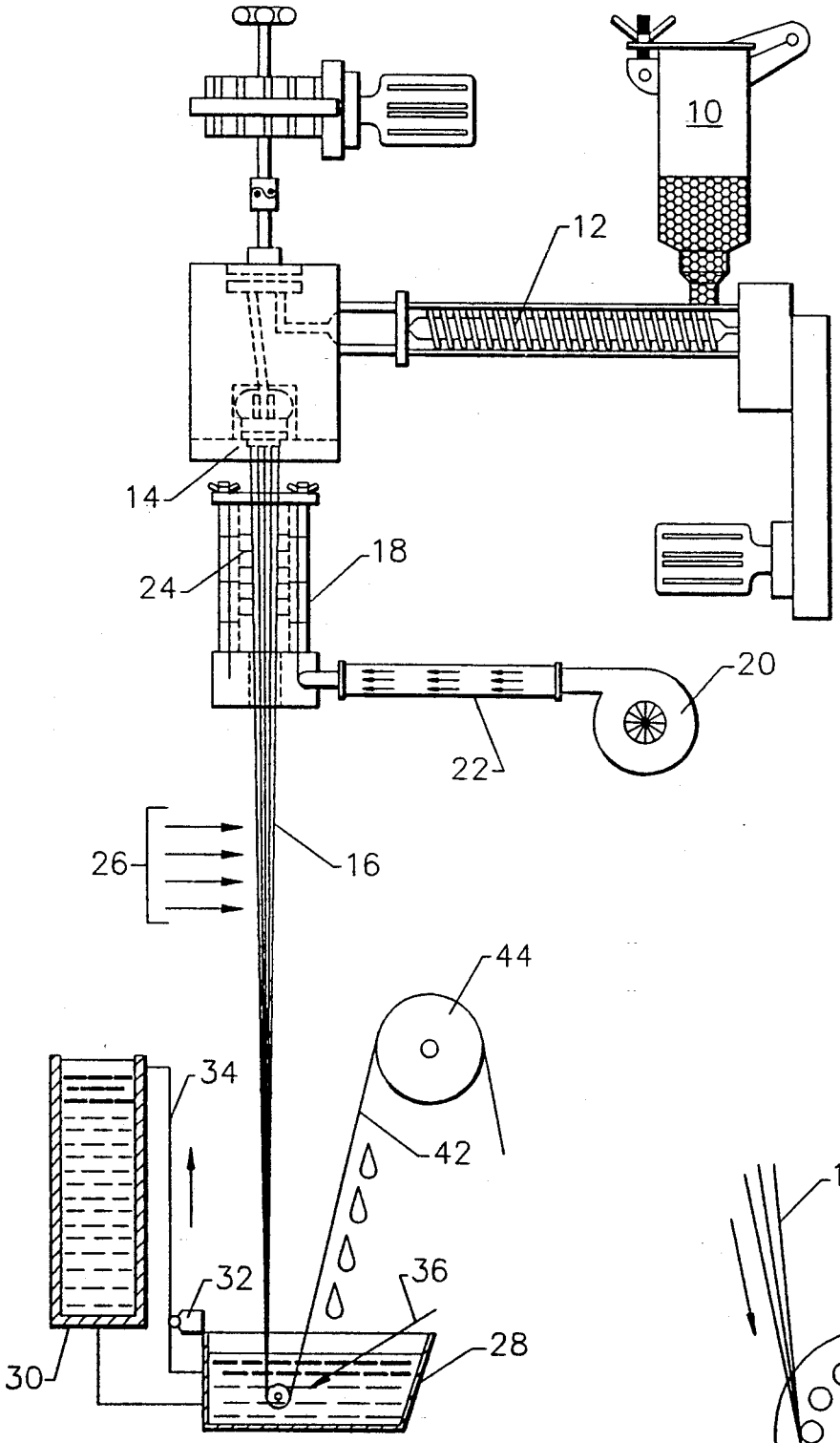
FIG. 1 schematically illustrates preferred apparatus for conducting the process of the invention.

FIG. 1 illustrates a suitable apparatus for conducting the process of the invention. A conventional polymer supply, 10 which may be a hopper or other source of polymer, supplies polymer chip which is melted in the barrel and then conveyed via a feeding means such as extrusion screw 12 to a spinning block 14 which includes one or more orifices for extrusion of molten thermoplastic polymer. The extruded polymer issues from the spinning block as a threadline 16. The threadline is then preferably passed through a thermal conditioning zone 18 which prevents immediate quenching of the threadline. Advantageously, the thermal conditioning zone 18 provides radially inflowing hot air via fan 20 and heater 22. The radially inflowing hot air indicated by arrows 24 is advantageously provided at a temperature which is higher than the glass transition temperature of the particular thermoplastic polymer. More preferably, the heated radial inflow air 24 is provided at a temperature which is close to the melting point of the polymer. Thus, the radially inflowing air can be provided at a temperature of greater than about 100° C. below the melting point of the polymer, preferably at a temperature of greater than 50° C. below the melting temperature of the polymer. In the case of poly(ethylene terephthalate), the inflow air can be advantageously provided at temperature of between about 200° C. and about 300° C., for example at about 250° C. which is near the melting point of the polymer. Other zones for heating of a threadline can be substituted for the thermal conditioning zone illustrated in FIG. 1.

The threadline issuing from the thermal conditioning zone 18 is thereafter passed through a quench zone 26 wherein the threadline is solidified and quenched to a temperature which is preferably below the glass transition temperature of the thermoplastic polymer. Thus, in the case of poly(ethylene terephthalate) having an amorphous glass transition temperature of 70° C., the threadline can be preferably quenched to a temperature in the range of below about 60° C. for example, from 25° C. to 50° C. Quench zone 26 can be of any conventional design and construction including a cooled cross-flow or radial-flow quench, ambient air quench or the like as will be apparent to the skilled artisan.

The cooled threadline is thereafter immediately passed into hydraulic drag bath 28 which is provided at a temperature above the glass transition temperature of the thermoplastic polymer, preferably above 100° C. The liquid in the hydraulic drag bath can be water when the temperature is maintained below 100° C. When the temperature is maintained at above 100° C., the liquid can be a suitable inert high boiling liquid having a boiling point preferably above about 150° C., such as 1,2-propanediol; a silicone oil, a mineral or hydrocarbon oil or the like. The height and temperature of the liquid in the hydraulic drag bath 28 are maintained with an auxiliary circulating system including a reservoir 30, a pump 32, conduit lines 34 and a heating means (not shown).

The threadline is passed through the hydraulic drag bath for a suitable length of liquid to substantially increase the stress on the threadline to a stress of preferably greater than about 1 gram per denier up to, for example, 4–5 grams per denier, depending on the nature of the thermoplastic polymer forming the threadline. In the case of poly(ethylene terephthalate) polymer, the threadline is passed through greater than about 5 cm of liquid, preferably from about 5 to about 60 cm, for example, 10 to 40 cm of liquid at a temperature greater than Tg of the polymer, preferably at a temperature of between about 95° C. and 150° C. to provide a preferred threadline stress within the range of between about 1 and about 4, more preferably about 2 and about 3 grams per denier measured at the point where the threadline exits the hydraulic drag bath. As illustrated in FIG. 1, the threadline can be passed downwardly and then upwardly through the liquid drag bath. The total path length through the drag bath in such an arrangement will be on the order of two times the depth of the drag bath.

Figure 1A:
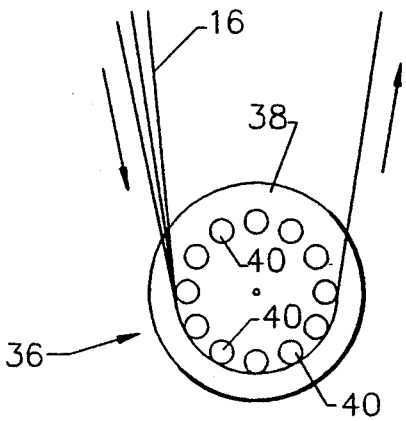
FIG. 1A schematically illustrates a preferred low friction guide pin apparatus employed in combination with the hydraulic drag bath.

The quenched threadline entering the hydraulic drag bath 28 passes downwardly through the hydraulic drag bath and is directed across a direction changing guide 36 located near the bottom of the hydraulic drag bath. One preferred direction changing guide 36 is generally illustrated in FIG. 1A which shows a stationary drum 38 equipped with a plurality of stationary sapphire pins 40 mounted on one circular end face of the drum. The sapphire pins provide a low friction surface for changing the direction of the threadline. By employing a group of circularly arranged sapphire pins as shown in FIG. 1A, the threadline stress can be distributed across a plurality of pin surfaces thereby reducing the friction experienced by the threadline. One such direction changing guide which has been successfully used by the inventors includes eight sapphire pins, each having a diameter of about 1 mm, and arranged in a circle having a diameter of about 0.375 in. (9.5 mm) and is commercially available from Yuasa Yarn Guide Engineering Co. Ltd., Nagoya, Japan.

As the threadline passes through the hydraulic drag bath 28, the diameter of the threadline is substantially reduced. The thus drawn threadline 42 is withdrawn from hydraulic drag bath 28 by a high speed winder 44 at a speed in excess of about 3,000 meters per minute. Typically, the withdrawal speed from the hydraulic drag bath will be between about 3 and about 7 times the speed of the quenched fiber threadline 16 entering the hydraulic drag bath. Thus, the threadline is drawn at a draw ratio of between about 3:1 to about 7:1 in hydraulic drag bath 28.

FIGS. 2–8E illustrate graphically the effects of varying process parameters in various aspects of the process of the invention. The values illustrated in the figures were obtained using an experimental apparatus as illustrated in FIG. 1. The spinning block consisted of a hyperbolic spinneret with a round orifice of 0.6 mm in diameter as described by Ihm and Cuculo in Journal of Polymer Science, Polymer Physics, 25, 619 (1987) which is hereby incorporated by reference. When used, the thermal conditioning zone consisted of a heating chamber capable of accommodating radial inflow hot air at 250° C. and 120 feet/minute flow rate. The heating apparatus was placed in the threadline path with a 10 cm gap between the face of the spinneret and the top of the heating chamber. The heating chamber was 13 cm long and had an 8.1 cm inside diameter. The hydraulic drag bath was placed such that the surface of the liquid was 420 cm from the face of the spinneret and 150 cm from the take-up roll. The liquid medium used in the hydraulic drag bath was water at temperatures below 100° C. and 1,2-propanediol at temperatures above 100° C.

Figure 2:
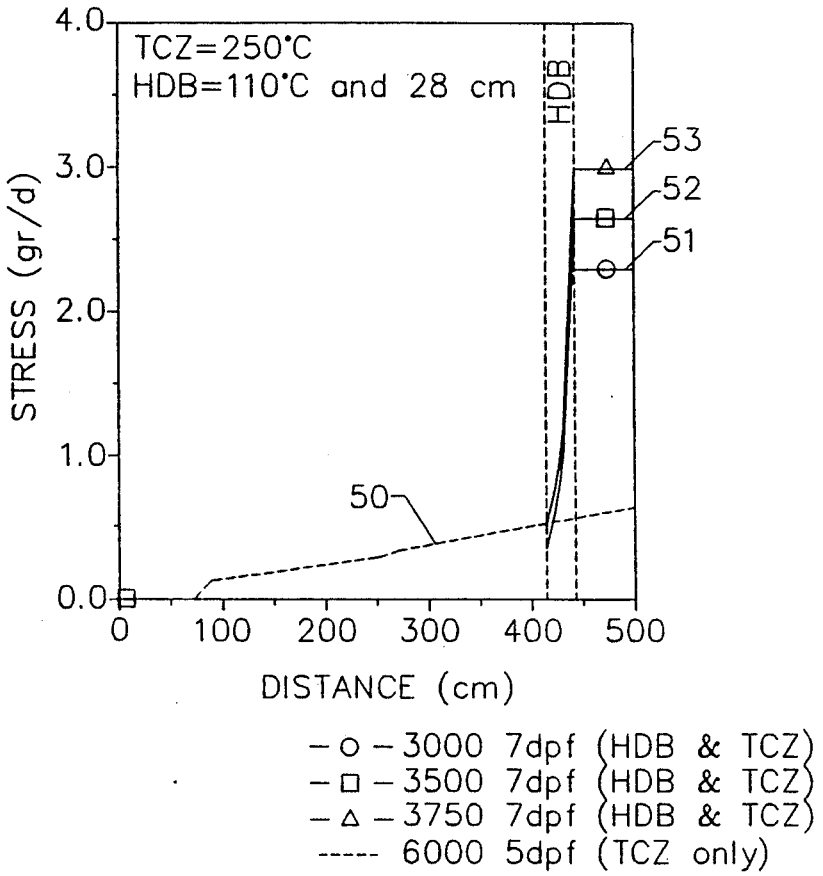
FIG. 2 is a graph illustrating the stress profile of a poly(ethylene terephthalate) threadline spun according to the process of the invention and illustrates the substantial threadline stress caused by the hydraulic drag bath.

FIGS. 2, 3, 4 and 5 illustrate typical threadline values obtained when employing the process of the invention. With reference to FIG. 2, the stress on the threadline is shown as a function of the threadline distance from the face of the spinneret. It is to be noted that threadline tension measurements were made, as stated earlier, only at the point where the threadline had reached its final spinning speed. Thus, in FIG. 2, dotted line 50 was extrapolated from measurements made by spinning at a speed of 6,000 meters per minute using a thermal conditioning zone (TCZ) at 250° C. but without using a hydraulic drag bath (HDB). Solid lines, 51, 52 and 53 represent actual threadline stress measurements taken at the spinning speed shown with the threadline denier per filament (dpf) as shown in FIG. 2 and wherein the polymer was PET having an IV of 0.95. In all cases, the hydraulic drag bath had a threadline path length of 28 cm and temperature of 110° C. The lines connecting dotted line 50 with lines 51, 52 and 53 represent extrapolated data and illustrate the degree of stress increase as the filament passed through the hydraulic drag bath.

As illustrated in FIG. 2, there is a substantial increase in stress when the PET threadline passes through the hydraulic drag bath. Also as indicated in FIG. 2, it can be seen that the amount of stress increases with increasing wind-up speed. Depending upon the particular thermoplastic polymer used, there will be a point at which the stress can cause frequent threadline breakage. At such point, the process becomes unrunable. By decreasing the wind-up speed, or by decreasing the length of the hydraulic drag bath, or by changing the temperature of the hydraulic drag bath, the stress on the threadline can be reduced to within the range where the process is again readily operable.

Figure 3:
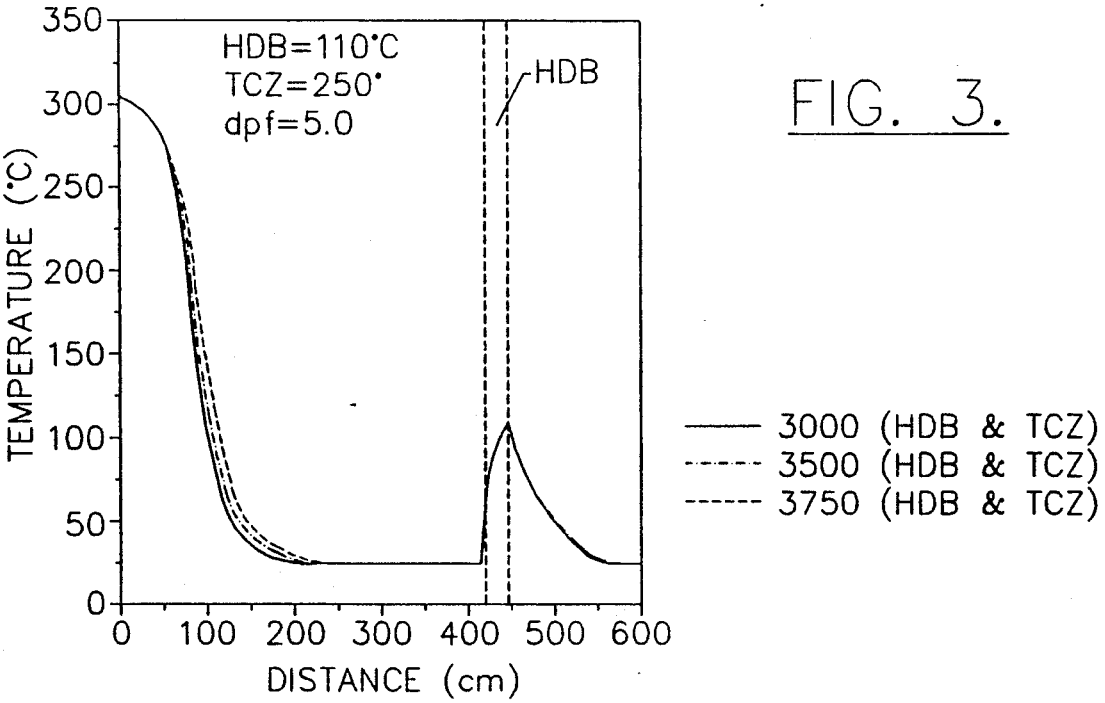
FIG. 3 is a graph illustrating temperature profiles of poly(ethylene terephthalate) threadlines spun at different spinning speeds according to the process of the invention.

FIG. 3 illustrates the effect of the hydraulic drag bath on the temperature profile of PET threadlines (IV=0.95) spun at various take-up speeds wherein, in each case the threadline was spun to a final dpf of 5.0. The data shown in FIG. 3 were obtained using the same hydraulic drag bath (HDB) and the same thermal conditioning zone (TCZ), both operated at the same conditions as shown in FIG. 2. With reference to FIG. 3, it can be seen that the temperature of the threadline rapidly drops off until the threadline reaches a temperature of about ambient temperature. Although the threadline temperatures were not actually measured in the hydraulic drag bath zone indicated in FIG. 3 by the dotted portion of the graph labeled "HDB", it will be seen as illustrated in FIG. 3 that the temperature of the threadline rapidly increases as it passes through hydraulic drag zone. Thereafter, the temperature rapidly falls off again to ambient temperature.

Figure 4:
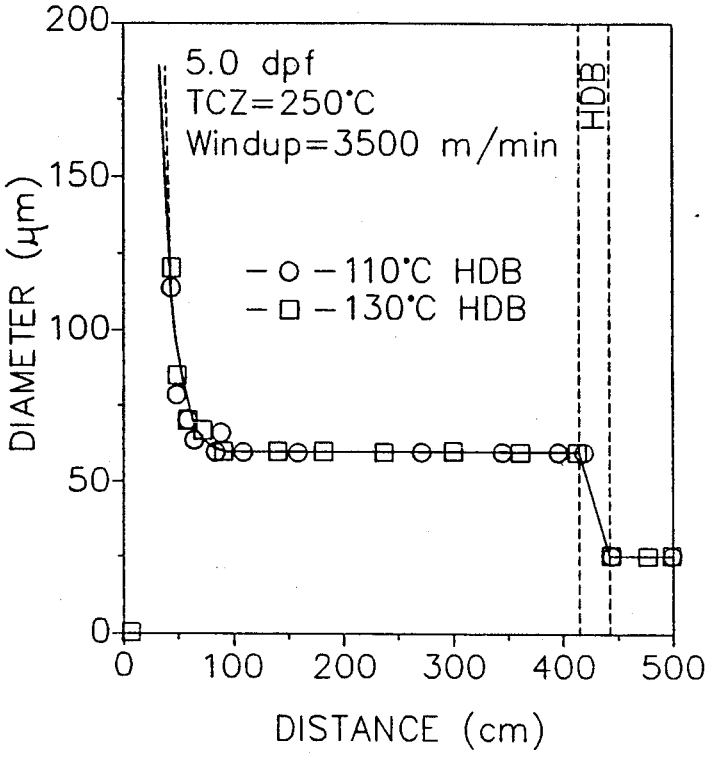
FIG. 4 is a graph illustrating diameter profiles of poly(ethylene terephthalate) threadlines spun according to the invention.

FIG. 4 illustrates the changing threadline diameter as the threadline moves away from the face of the spinneret. As in the previous figures, no actual measurements were made in the hydraulic drag bath and thus the data in this portion of the graph represents extrapolated data. It will be seen, however, that the diameter of the threadline rapidly decreases until quenching of the threadline. Then, as the threadline passes through the hydraulic drag bath the diameter of the threadline is again reduced by about 50% or greater. This was true for hydraulic drag baths maintained at a temperature of both 110° C. and 130° C.

Figure 5:
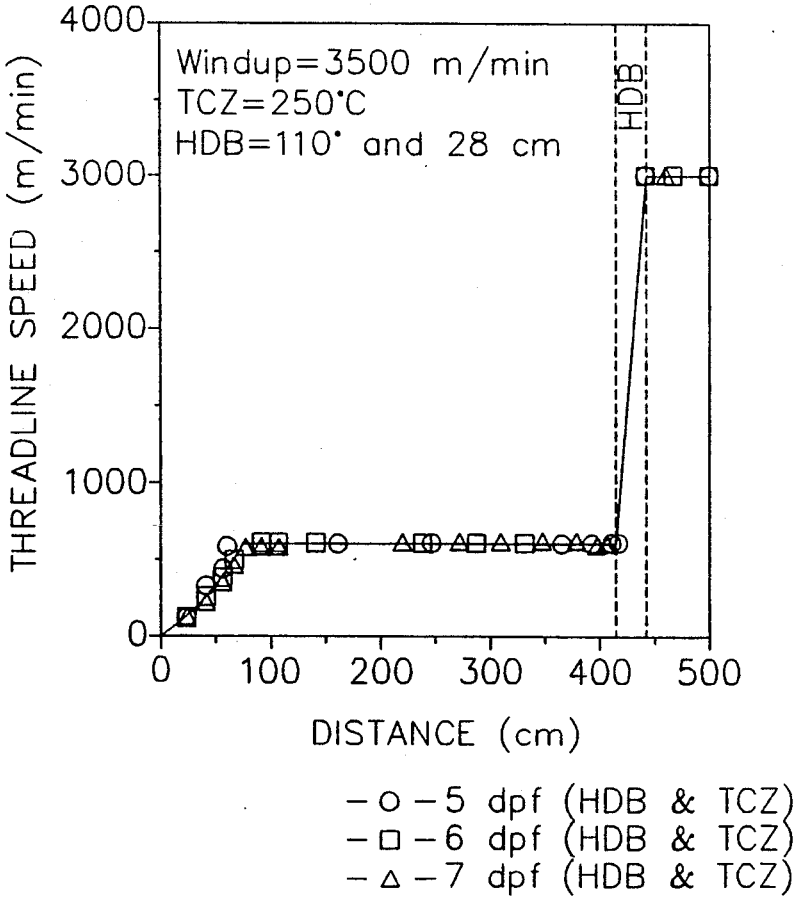
FIG. 5 is a graph illustrating velocity profiles of poly(ethylene terephthalate) threadlines spun according to the invention.

FIG. 5 illustrates the velocity profile of the threadline as a function of the distance from the spinneret face. The threadline rapidly increases in speed until it is substantially quenched. Prior to the hydraulic drag bath, the threadline reaches a maximum speed in the range of 600–700 m/min. As the threadline passes through the hydraulic drag bath, the speed rapidly increases to 3,000 m/min. Thus, under the conditions shown in FIG. 5, the threadline was drawn at a ratio of between about 4:1 and 5:1 as it passed through the hydraulic drag bath. It is believed that the process of this invention is operable at threadline speeds prior to the hydraulic drag bath ranging from about 500 m/min up to about 2000 m/min or greater, preferably from about 500 m/min to about 1000–1500 m/min.

Figure 6:
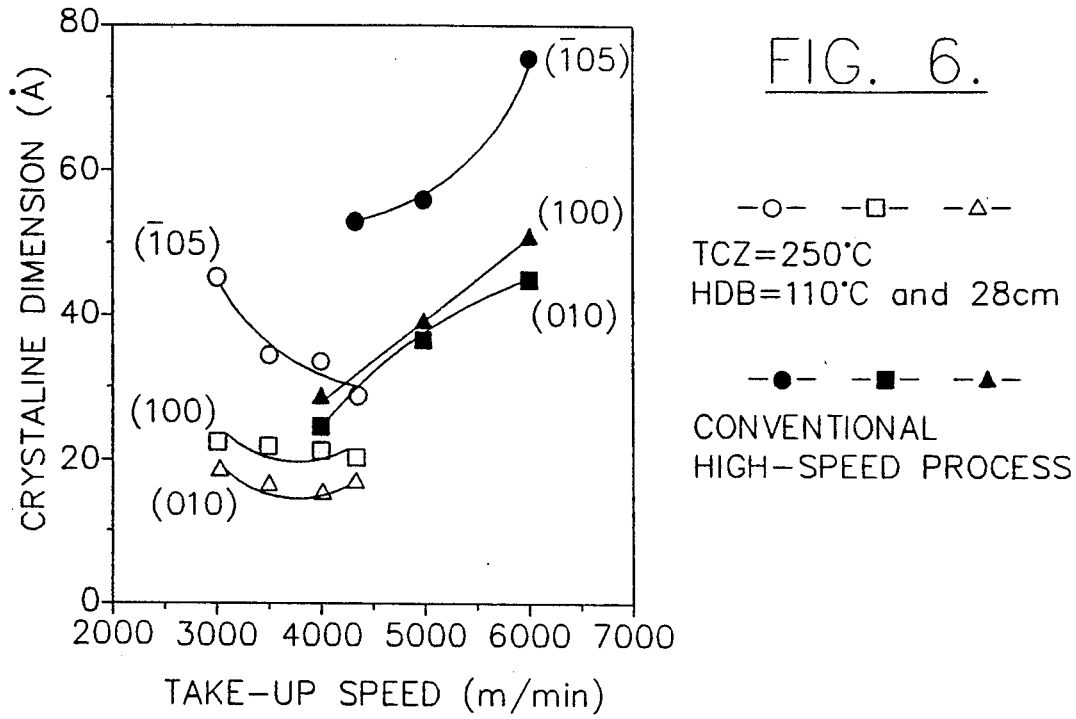
FIG. 6 is a graph illustrating poly(ethylene terephthalate) crystalline dimensions in fibers spun conventionally and according to the invention at different spinning speeds.

FIG. 6 illustrates crystalline dimensions of as-spun fibers prepared at different wind-up speeds using the thermal conditioning zone and the hydraulic drag bath conditions identified in FIG. 6. Also shown in FIG. 6 are crystalline dimensions of as-spun PET fibers spun according to the conventional high speed spinning process. It will be apparent that with fibers spun according to this invention the crystalline size of PET crystals decreases as a function of take-up speed in marked contrast to the conventional process. It will also be apparent that the crystalline size of PET crystalline structures in fibers prepared according to the process of the invention are unusually small as compared to conventional high speed spun fibers.

Figure 7A:
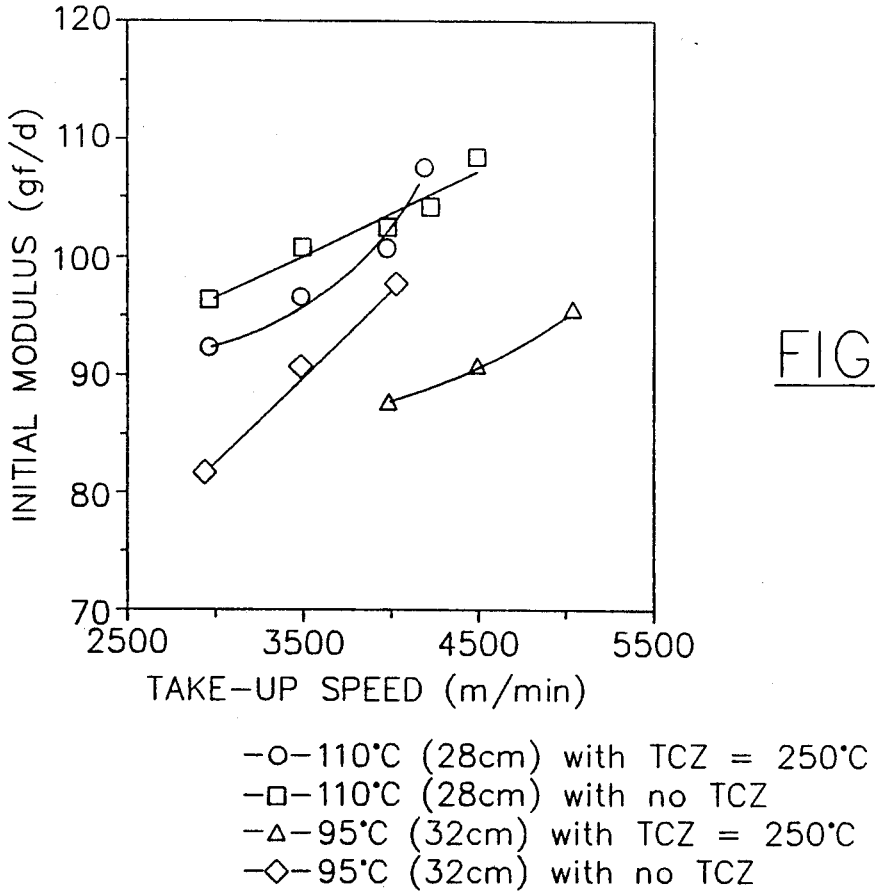
FIGS. 7A–7C are graphs illustrating various fiber properties of poly(ethylene terephthalate) fibers spun in accordance with various aspects of the invention.
Figure 7B:
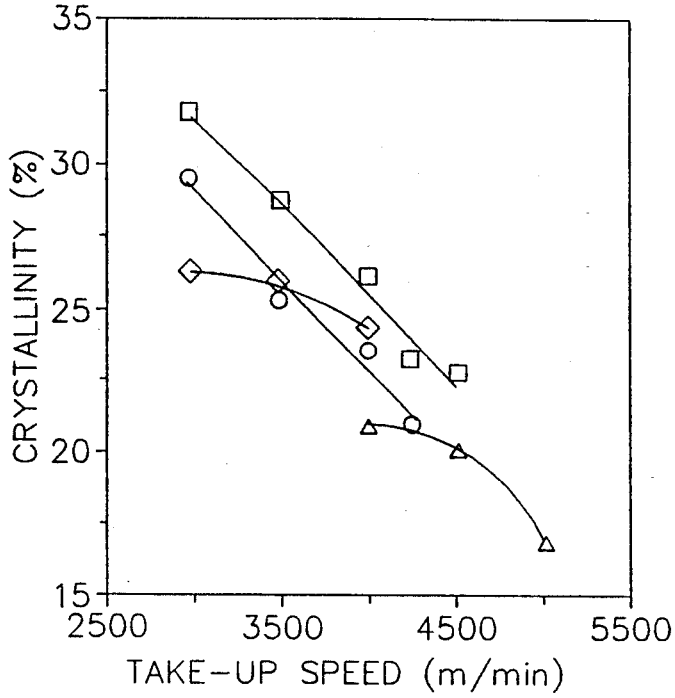
Figure 7C:
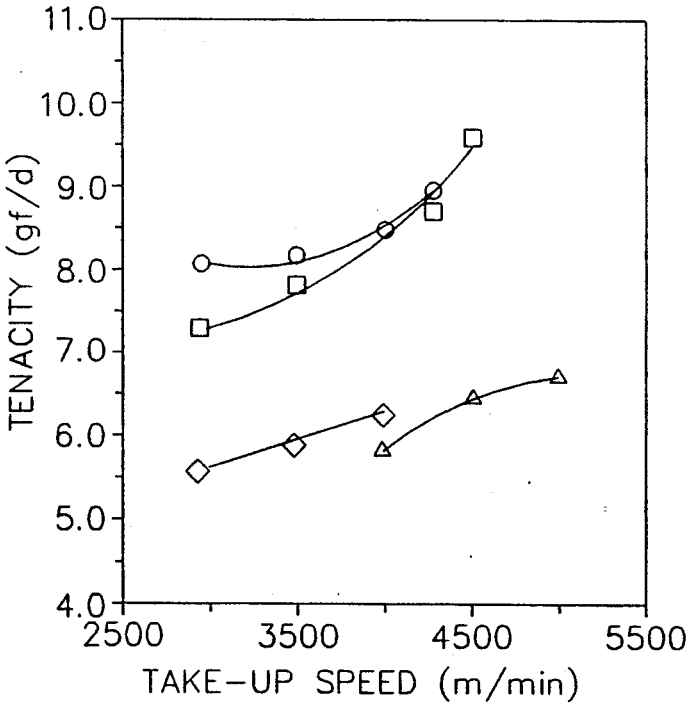
Figure 8A:
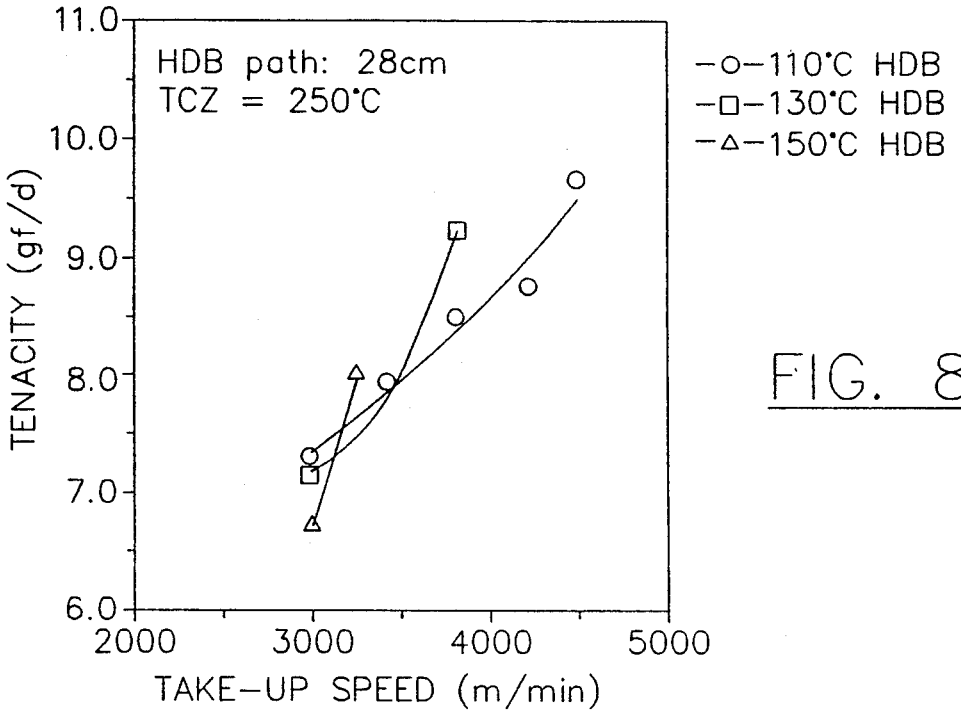
FIGS. 8A–8E are graphs illustrating variations in fiber properties of poly(ethylene terephthalate) fibers spun according to the invention using hydraulic drag baths of differing temperatures.
Figure 8B:
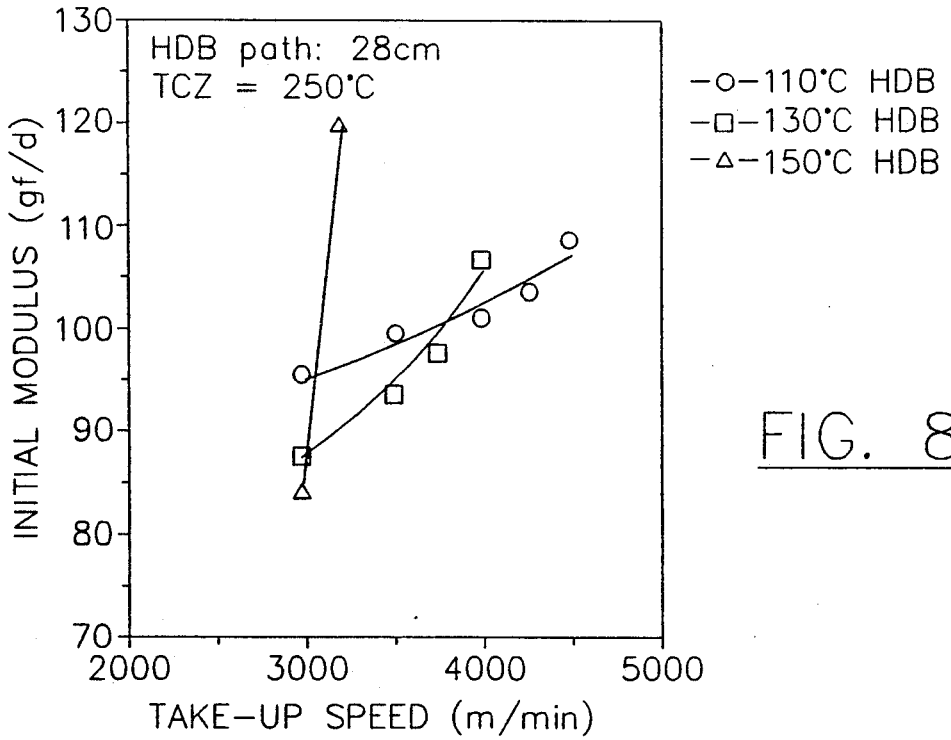
Figure 8C:
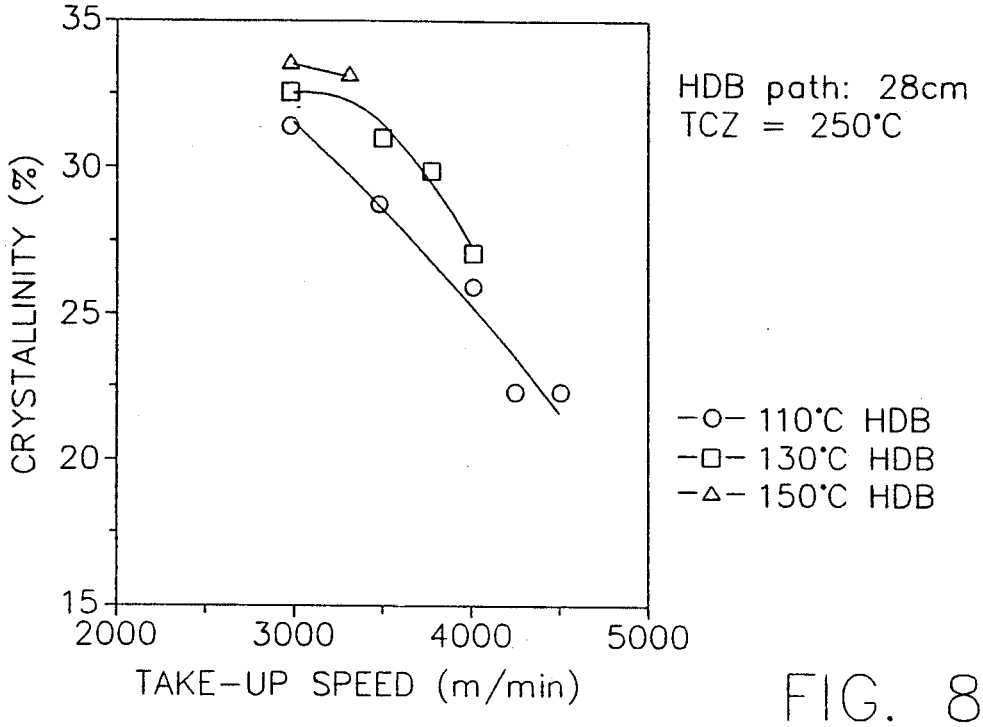
Figure 8D:
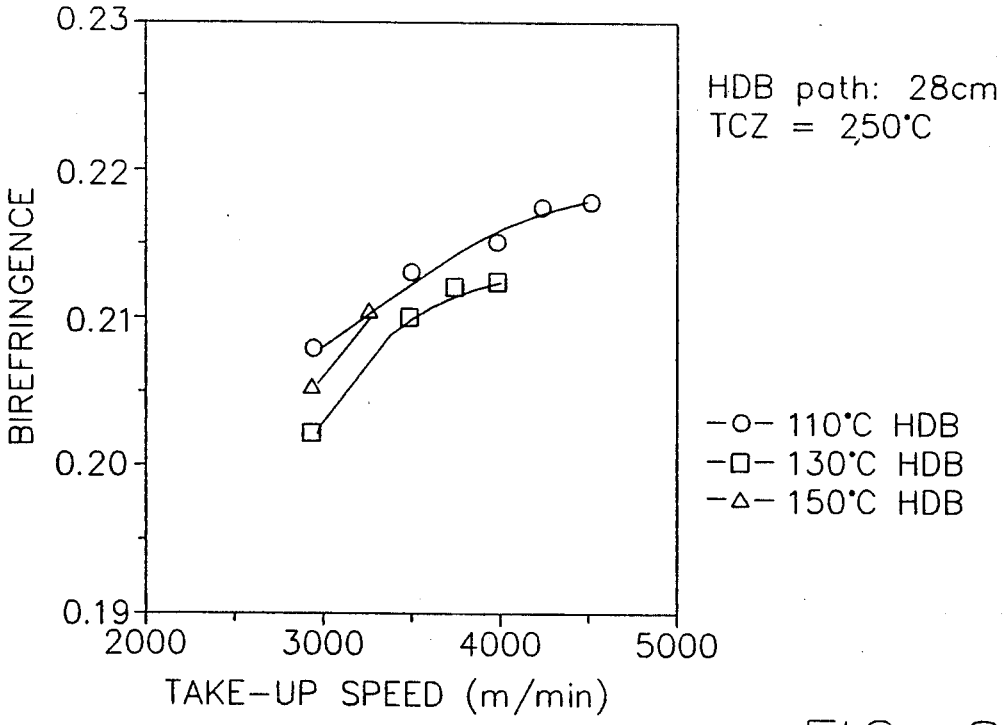
Figure 8E:
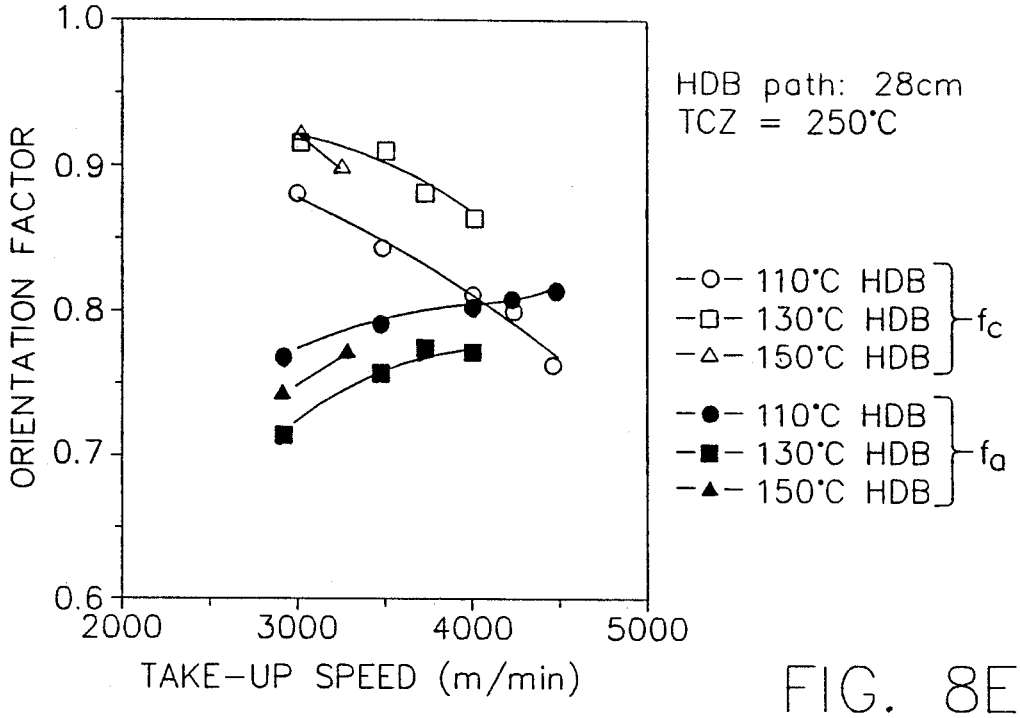

FIGS. 7A, 7B and 7C illustrate, respectively, how initial modulus, crystallinity and tenacity values of as-spun fibers change with changes in take-up speed and also as a function of temperature of the hydraulic drag bath and additionally depending on whether or not a thermal conditioning zone was employed. It will be seen that fiber tensile values of tenacity and initial modulus are substantially improved by changing the hydraulic drag bath temperature from 95° C. to 110° C. In addition, tensile values are generally improved by the thermal conditioning zone. In all cases the crystallinity of the as-spun fibers was below about 32% crystallinity. In addition, crystallinity decreases as a function of take-up speed. Although not shown in FIGS. 7A–7C the thermal conditioning zone, when used, was also found to improve the runability of the process.

FIGS. 8A–8E illustrate the effect of hydraulic draw bath temperature on process runability; on fiber tensile values; and on fiber crystallinity and orientation. In each case, the fibers were spun to a dpf of 5 at different spinning speeds and the process was discontinued at the spinning speed where excessive filament breakage occurred. As seen in FIGS. 8A–8E, the hydraulic draw bath temperature of 110° C. gave the greatest amount of process runability, whereas at a hydraulic draw bath temperature of 150° C. runability was poor above speeds of about 3,200 m/min. The fiber tenacity values were greatest with hydraulic drag bath temperatures of 110°–130° C. and increased with increasing take-up speeds. Modulus values similarly increase as a function of spinning speed. Crystallinity values decreased as function of spinning speed and were within the range of 20–32% and, more typically in the range of 20–30%. Orientation or birefringence was higher as a function of spinning speed and was typically within the range of 0.20 and 0.22. The degree of amorphous orientation ($f_a$) was generally within the range of about 0.75 to about 0.85 and increased with increasing spinning speed. The degree of crystalline orientation ($f_c$) was generally within the range of 0.75 to about 0.9 and decreased with increased spinning speed.

Figure 9A:
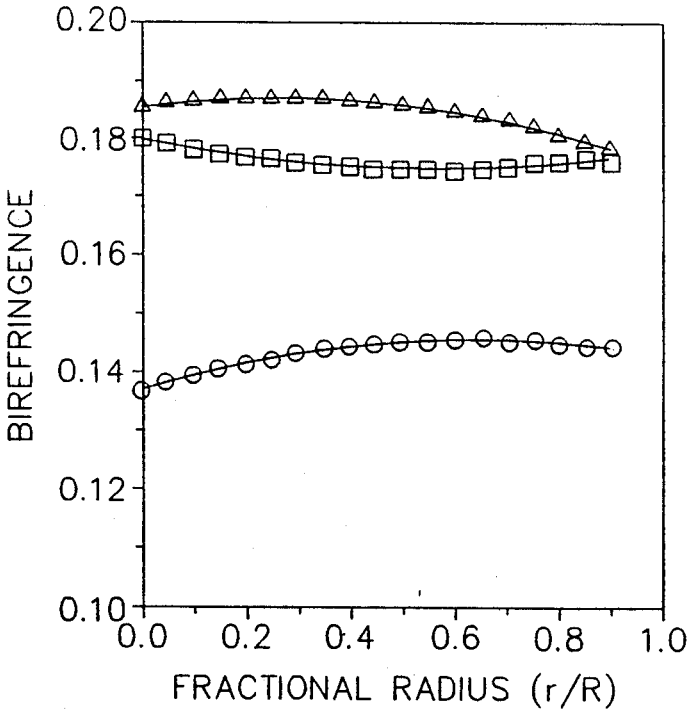
FIGS. 9A and 9B are graphs illustrating the radial distribution of birefringence values and densities which can be obtained in fibers spun according to the invention.

FIG. 9A shows the typical radial birefringence of fibers spun with the hydraulic drag bath under different conditions. In general, the radial variation of birefringence is shown to be small, at most within 0.01 difference between the sheath and the core even in the case of a hydraulic drag maintained at 25° C. When the liquid temperature is raised to 95° C., the birefringence increases dramatically. At liquid temperatures above 95° C., the radial distribution of the birefringence becomes essentially "flat". These results support the fact that the hydraulic drag bath maintains a good isothermal environment in which the structure can develop under a high level of spinning stress.

Figure 9B:
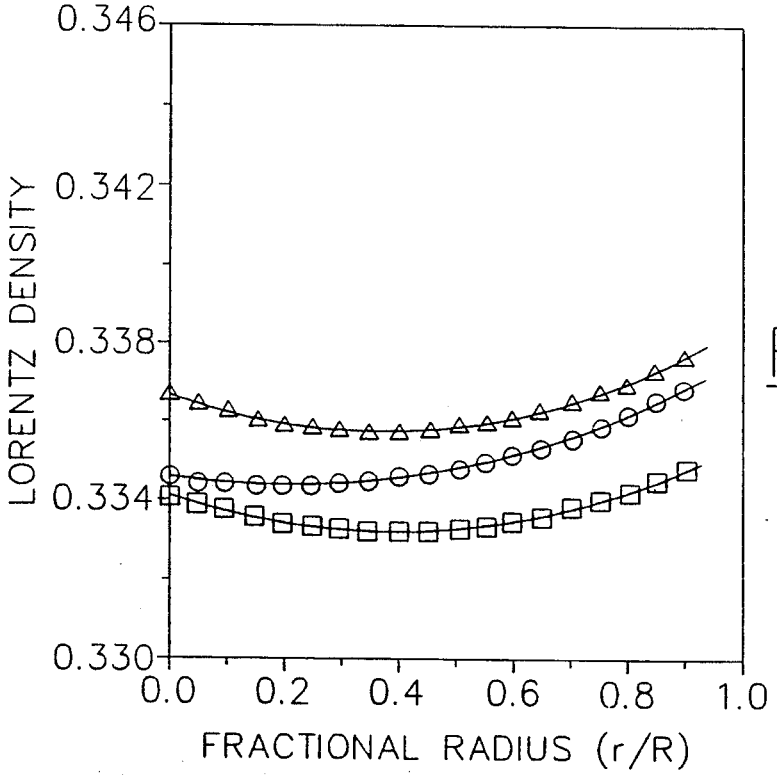

FIG. 9B shows the radial distribution of Lorentz density, an optical measure of crystallinity. The sheath portions of the hydraulic drag bath spun fibers are found to have a slightly higher Lorentz density than does the core. However, the difference, at most $2\times10^{-3}$, is still small. It is concluded that filaments spun under the hydraulic drag bath possess a uniform distribution of structure in the cross-section of the fibers. This contributes greatly toward the attainment of superior mechanical properties in the fibers.

In general, the process of this invention is suitable for the melt spinning of numerous synthetic polymers including polyesters such as PET, nylons such as nylon 6 and nylon 6,6, polyolefins such as polypropylene and polyethylene, and the like. The process of the invention can be carried out over a wide range of conditions both with and without use of a thermal conditioning zone to delay quenching of the spun threadline or to provide quenching of the spun threadline under a variety of controlled conditions. Thus, thermal conditioning zones can be employed over a wide range of temperatures and with a wide range of lengths. The process of the invention can be conducted using a wide range of temperatures in the hydraulic drag bath and with a wide range of hydraulic medium. In addition, various types of mechanical apparatus can be used in the hydraulic drag bath to guide the filaments into and out of the hydraulic drag bath. Fibers produced according to the invention can be produced over a wide range of total deniers and deniers per filament. In multi-filament yarns prepared according to the process of the invention the number of filaments can be varied widely. The process of the invention can be operated over a large range of wind-up or take-up speeds of, for example, between about 3,000 meters per minute up to 6,000 meters per minute or greater. The fibers produced according to the invention are suitable for use without further post-treatments; however, the fibers may be further modified, if desired by post-treatments such as drawing, annealing and texturing.

The following examples are set forth in order to further illustrate the invention. In these examples, the experimental apparatus and set-up described previously in connection with FIGS. 2–8E was employed. In each of the examples, the polymer used was PET having an IV of 0.95. Unless otherwise stated, the mass flow rate per orifice was adjusted to produce a linear density of 5.0 denier per filament. The values given for fiber properties in the examples were determined in the manner discussed previously. Unless otherwise indicated "% crystallinity" is "wt % crystallinity".

EXAMPLE 1

A poly(ethylene terephthalate) (PET) having an intrinsic viscosity of 0.95 dl/gm was melted in the spinning block at 305° C. and was then extruded from a hyperbolic spinneret of 0.6 mm diameter into a filament. After passing a 420 cm path open to ambient conditions, the filament was then passed at a total path length of 8 cm through a hydraulic drag bath (HDB) of water at 25° C. The birefringence thus obtained was 0.184 at 5,500 m/min take-up speed. The tensile properties for tenacity, ultimate elongation and initial modulus, respectively, were 5.97 g/d, 42.3% and 78.0 g/d.

EXAMPLE 2

The filament was extruded under the same spinning conditions as in Example 1 except that the filament was passed through a 10 cm gap open to ambient conditions and then passed through a 13 cm long thermal conditioning zone at 250° C. for the purpose of delaying the cooling. After cooling down nearly to the ambient temperature, the filament was then passed at a total path length of 32 cm through the hydraulic drag bath of water at 95° C. The birefringence thus obtained was 0.213 at 5,000 m/min take-up speed. The tensile properties for tenacity, ultimate elongation and initial modulus, respectively, were 6.78 g/d, 18.7% and 98.3 g/d.

EXAMPLE 3

Example 3 was prepared in the same manner as in Example 2 that the liquid medium used in the hydraulic drag bath was 1,2-propanediol. In the bath, the filament was passed at a total path length of 28 cm through the hydraulic drag bath of 1,2-propanediol at 110° C. The birefringence thus obtained was 0.217 at 4,500 m/min take-up speed. The tensile properties for tenacity, ultimate elongation and initial modulus, respectively, were 9.72 g/d, 16.4% and 109.5 g/d.

EXAMPLES 4 and 5

Example 4 was conducted in the same manner as in Example 3 except that the filaments were wound at 3,500 m/min. In Example 5, the filaments prepared in Example 4 were then subjected to a separate drawing and annealing condition between a set of rolls. The drawing and annealing conditions together with the filament properties are listed in Table 1 below.

TABLE 1

| Example | Birefringence | Tenacity g/d | Initial Modulus g/d | Ultimate Elongation % | Crystallinity % |
|---|---|---|---|---|---|
| 4 (HDB-Spun) | 0.221 | 8.16 | 112.8 | 15.70 | 24.81 |
| 5 Drawn & Annealed | 0.237 | 10.21 | 114.0 | 10.01 | 48.50 |

| Spinning condition: | | Drawing & Annealing Condition | |
|---|---|---|---|
| Polymer: | 0.95 IV PET | Pre-heat roll: | 90° C. |
| Spinning speed: | 3500 m/min | Hot plate: | 250° C., 10" |
| Spun fiber denier: | 5 dpf | Draw ratio: | 1.2 |
| TCZ: | 250° C. | Take-up speed: | 10/min |
| HDB temperature: | 110° C. | | |

TABLE 1-continued

| | |
|---|---|
| HDB path: | 28 cm |

EXAMPLES 6–8

Filaments were obtained under the same conditions as in Example 3 except that the total path length through the hydraulic drag bath was 12 cm and at various temperatures of the 1,2-propanediol. In addition, the take-up speed was adjusted at the optimal condition corresponding to the bath temperature. Filament properties obtained under the respective conditions are listed in Table 2.

TABLE 2

| Example No. | Spinning Speed m/min* | HDB Temp. C. | Tenacity g/d | Ultimate Elongation % | Initial Modulus g/d | Birefringence | Crystallinity % | Boil-off Shrinkage % |
|---|---|---|---|---|---|---|---|---|
| 6 | 4750 | 120 | 7.49 | 25.9 | 112.1 | 0.217 | 27.34 | 15.53 |
| 7 | 4500 | 150 | 6.82 | 22.6 | 109.3 | 0.194 | 36.45 | 6.35 |
| 8 | 4250 | 180 | 6.84 | 26.6 | 103.0 | 0.189 | 43.10 | 5.88 |

Spinning condition:

| | |
|---|---|
| Polymer: | 0.95 IV PET |
| TCZ: | 250° C. |
| HDB path: | 12 cm |

*Maximum attainable spinning speed.

EXAMPLES 9–12

Filaments were spun under the same conditions as in Example 3 except that the throughput was adjusted for spinning filaments of different linear density at 4000 m/min and using the hydraulic drag bath conditions shown below. Filaments properties are listed in Table 3.

TABLE 3

| Example No. | Spinning Denier | Tenacity g/d | Ultimate Elongation % | Initial Modulus g/d | Birefringence | Crystallinity % | Boil-off Shrinkage % |
|---|---|---|---|---|---|---|---|
| 9 | 4.5 dfp | 11.80 | 21.50 | 125.8 | 0.220 | 22.29 | 10.88 |
| 10 | 5.0 dfp | 8.70 | 18.76 | 102.0 | 0.216 | 23.25 | 10.06 |
| 11 | 6.0 dfp | 8.04 | 16.89 | 97.13 | 0.204 | 26.65 | 12.77 |
| 12 | 7.0 dfp | 7.57 | 24.8 | 91.77 | 0.209 | 27.86 | 13.81 |

Spinning condition:

| | |
|---|---|
| Polymer: | 0.95 IV PET |
| Spinning speed: | 4000 m/min |
| TCZ: | 250° C. |
| HDB temperature: | 110° C. |
| HDB path: | 28 cm |

EXAMPLES 13 and 14

Both of these Examples were run at 4,250 m/min. The spinning conditions and filaments characteristics are given in Table 4. Example 13 shows a comparatively high amorphous orientation factor and high tenacity values. At higher liquid temperature in the bath, as indicated in Example 14, the path in the bath was reduced in order to improve process operability.

TABLE 4

| Example No. | Spinning Speed m/min | HDB Temp. C. | HDB Length* cm | Tenacity g/d | Ultimate Elongation % | Initial Modulus g/d | Birefringence |
|---|---|---|---|---|---|---|---|
| 13 | 4250 | 110 | 28 | 9.25 | 19.3 | 108.2 | 0.219 |
| 14 | 4250 | 180 | 12 | 6.84 | 26.6 | 103.0 | 0.189 |

| Example No. | Boil-Off Shrinkage % | Crystallinity % | $L_{010}$ Å | $L_{100}$ Å | $L_{105}$ Å | LPS Å | $f_c$ | $f_{am}$ |
|---|---|---|---|---|---|---|---|---|
| 13 | 9.14 | 21.06 | 18.04 | 20.08 | 28.96 | None | 0.832 | 0.828 |
| 14 | 5.88 | 43.10 | 36.44 | 36.22 | 63.22 | 159 | 0.957 | 0.633 |

| | |
|---|---|
| Polymer: | 0.95 IV PET |
| TCZ: | 250° C. |

*Maximum path length of HDB under attainable spinning conditions

EXAMPLES 15, 16, 17 and 18

In Examples 17 and 18, fibers were prepared under the same conditions as in the previous examples both with and without use of the thermal conditioning zone at the wind-up speeds and to produce the final fiber dpfs shown in Table 5. In Examples 15 and 16 high speed spun fibers were prepared using the same apparatus as in the previous examples but without use of the hydraulic drag bath and with and without use of the thermal conditioning zone. Properties for each of the four sets of fibers were measured and are set forth below in Table 5. It can be seen that the fibers produced by the process of this invention (Examples 17 and 18) have superior tensile properties as compared to high speed spun fibers (Examples 15 and 16).

TABLE 5

| | Example | | | |
|---|---|---|---|---|
| | 15 | 16 | 17 | 18 |
| Polymer | 0.95 IV PET | | | |
| HDB | NONE | | 1,2-propane diol | |
| Path, cm | — | — | 28 | 28 |
| Temp., °C. | — | — | 110 | 110 |
| TCZ, °C. | None | 250 | None | 250 |
| Speed, m/min | 5000 | 6000 | 4500 | 4000 |
| Denier (dpf) | 5 | 5 | 5 | 4.5 |
| Δn | 0.132 | 0.144 | 0.217 | 0.22 |
| Tenacity, g/d | 4.11 | 5.02 | 9.72 | 11.75 |
| (Mpa) | (500) | (613) | (1165) | (1416) |
| Modulus, g/d | 52.63 | 63.47 | 109.52 | 125.79 |
| (Gpa) | (6.4) | (7.8) | (13.1) | (15.2) |
| $\epsilon_b$, % | 95 | 53 | 16.4 | 21.5 |
| BOS, % | 2.8 | 2.3 | 15.1 | 10.9 |
| Density, g/cm$^3$ | 1.378 | 1.384 | 1.358 | 1.360 |
| Crystallinity % | 38.01 | 41.57 | 20.54 | 22.29 |

Δn: birefringence;
$\epsilon_b$: ultimate elongation;
BOS: boil-off shrinkage.

The invention has been described in considerable detail with reference to its preferred embodiments. However, it will be apparent that variations and modifications can be made within the teachings and spirit of the invention without departing from the scope of the invention as described in the foregoing specification and defined in the following claims.

That which is claimed is:

1. A process for preparing high strength, highly oriented thermoplastic filamentary material comprising:

melt spinning molten thermoplastic polymer through a spinneret to form a continuous threadline;

quenching the threadline to the temperature less than about the glass transition temperature of the thermoplastic polymer;

passing the quenched threadline through a hydraulic drag bath maintained to a temperature of greater than 100° C. for a sufficient distance to substantially increase the threadline stress and effect drawing of the threadline; and withdrawing the threadline from the hydraulic drag bath at a withdrawal rate of at least about 3,000 meters per minute whereby the thermoplastic filamentary material exhibits a strength of at least 7 grams per denier.

2. The process of claim 1 additionally comprising the step prior to quenching of the threadline, of passing the threadline through a thermal conditioning zone maintained at a temperature sufficient to delay quenching of the threadline.

3. The process of claim 1 wherein the hydraulic drag bath is maintained at a temperature of between about 100° C. and about 150° C.

4. The process of claim 3 wherein the liquid in the hydraulic drag bath has a boiling point of greater than about 150° C.

5. The process of claim 1 wherein the thermoplastic polymer is poly(ethylene terephthalate) having an intrinsic viscosity of greater than about 0.8.

6. The process of claim 1 wherein the quenched threadline is passed through hydraulic drag bath for a total path length of between about 5 and 60 cm.

7. The process of claim 1 wherein the step of passing the threadline through a hydraulic bath comprises directing the threadline into the top of the hydraulic drag bath and downwardly through the hydraulic drag bath to a depth of between about 5 and about 20 cm and, then passing the threadline across a direction changing guide submerged in the hydraulic drag bath to reverse direction of the threadline so that the threadline is withdrawn from the top of the hydraulic drag bath.

8. The process of claim 7 wherein the direction changing guide submerged in the hydraulic drag bath comprises a plurality of sapphire pins.

9. The process of claim 1 wherein the threadline stress measured at a location just subsequent to withdrawal of the threadline from the hydraulic drag bath is between about 2 and about 4 grams per denier.

10. The process of claim 9 wherein the threadline velocity measured at a location just subsequent to the withdrawal of the threadline from the hydraulic drag bath is between about 2 and about 6 times the threadline velocity measured at a location just prior to entry of the threadline into the hydraulic drag bath.

11. A process for preparing high strength, highly oriented thermoplastic filamentary material comprising:

melt spinning thermoplastic polymer through a spinneret to form a continuous threadline;

passing the threadline through a thermal conditioning zone maintained at a temperature sufficient to effect heating of the threadline and delay quenching of the threadline;

withdrawing the threadline from the thermal conditioning zone and quenching the thermally conditioned threadline to a temperature less than about the glass transition temperature of the thermoplastic polymer;

passing the quenched threadline through a hydraulic drag bath maintained at a temperature greater than the glass transition temperature of the thermoplastic polymer; and withdrawing the threadline from the hydraulic drag bath at a withdrawal rate substantially in excess of the speed of the quenched threadline entering into the hydraulic drag bath and of at least 3,000 meters per minute, whereby the highly oriented thermoplastic filamentary material exhibits a strength in excess of 7 grams per denier.

12. The process of claim 11 wherein the hydraulic drag bath is maintained at a temperature of between about 100° C. and 150° C.

13. The process of claim 12 wherein the hydraulic drag bath is maintained at a temperature between about 110° C. and about 130° C.

14. The process of claim 12 wherein the thermoplastic polymer is poly(ethylene terephthalate).

15. The process of claim 12 wherein the thermoplastic polymer is a polyamide.

16. The process of claim 12 wherein the threadline is drawn at a draw ratio of between about 2:1 and 6:1 during passage through the hydraulic drag bath.

17. The process of claim 12 wherein the thermal conditioning zone is maintained at a temperature in the range of about 200° C. and 300° C.

18. The process of claim 17 wherein the thermoplastic polymer is poly(ethylene terephthalate) having an intrinsic viscosity of greater than about 0.8.

19. The process of claim 12 wherein the threadline is passed through the hydraulic drag bath for a total path length of between about 10 cm and about 60 cm.

20. A process for producing high strength, highly oriented poly(ethylene terephthalate) filamentary material comprising:

melt spinning poly(ethylene terephthalate) polymer having an intrinsic viscosity of greater than about 0.9 through a spinneret to form a continuous threadline;

quenching the threadline to a temperature of less than about 70° C.;

passing the quenched threadline through a hydraulic drag bath maintained at a temperature of greater than 100° C.; and withdrawing the threadline from the hydraulic drag bath at a threadline stress of at least 1.0 grams per denier and at a withdrawal rate of at least 3,000 meters per minute said withdrawal rate being greater than the speed of the quenched threadline entering into the hydraulic drag bath, whereby high strength, highly oriented poly(ethylene terephthalate) filamentary material having a strength of greater than 7 grams per denier is produced.

21. The process of claim 20 additionally including the step prior to the quenching step of passing the threadline through a thermal conditioning zone maintained at a temperature in the range of about 200° C. and about 300° C.

22. The process of claim 20 wherein the hydraulic drag bath is maintained at a temperature of less than about 180° C.

23. The process of claim 20 wherein the hydraulic drag bath is maintained at a temperature of less than about 150° C.

24. The process of claim 20 wherein the threadline is drawn at a draw ratio of between about 2:1 and 5:1 during passage through the hydraulic drag bath.

25. The process of claim 20 wherein the threadline is passed through the hydraulic drag bath for a distance of between about 10 and about 40 cm.

26. The process of claim 25 wherein a direction changing guide is submerged in the hydraulic drag bath and wherein the threadline is passed across the direction changing guide and withdrawn from the top of the hydraulic drag bath.

27. A process for producing high strength, high oriented thermoplastic filamentary material comprising:

melt spinning molten thermoplastic polymer through a spinneret to form a continuous threadline;

directing the threadline into a thermal conditioning zone maintained at a temperature sufficient to heat the threadline and delay quenching of the threadline;

directing the threadline from the thermal conditioning zone into a quench zone wherein the threadline is quenched to a temperature of less than about the glass transition temperature of the thermoplastic polymer;

directing the threadline from the quench zone into the top of a hydraulic drag bath maintained at a temperature greater than the glass transition temperature of the thermoplastic polymer;

directing the threadline downwardly through the hydraulic drag bath and then passing the threadline across a direction changing guide submerged in the hydraulic drag bath to reverse direction of the threadline whereby the total path length of the threadline through the hydraulic drag bath is between about 5 and about 60 cm and whereby the threadline is drawn during passage through the hydraulic drag bath; and withdrawing the threadline from the top of the hydraulic drag bath at a withdrawal rate of at least about 3,000 meters per minute to produce poly(ethylene terephthalate having a strength of at least 7 grams per denier.

28. The process of claim 27 wherein the hydraulic drag bath is maintained at a temperature between about 95° C. and about 150° C.

29. The process of claim 27 wherein the thermoplastic polymer is poly(ethylene terephthalate).

30. The process of claim 28 wherein the thermal conditioning zone is maintained at a temperature in the range of between about 200° C. and about 300° C.

31. The process of claim 28 wherein the threadline is drawn at a draw ratio of greater than about 2:1 during passage through the hydraulic drag bath.

32. The process of claim 28 wherein the total path length of the threadline through the hydraulic drag bath is between 10 and 40 cm.

* * * * *

UNITED STATES PATENT AND TRADEMARK OFFICE

CERTIFICATE OF CORRECTION

PATENT NO. : 5,171,504

DATED : December 15, 1992

INVENTOR(S) : Cuculo et al.

It is certified that error appears in the above-identified patent and that said Letters Patent is hereby corrected as shown below:

Column 5, line 5, "K60" should be -- $K_a$ --.

Column 5, line 25, "$(_{105}-)$" should be -- $(\bar{}_{105})$ --.

Column 5, line 40, "$\phi_{105,z}-$" should be -- $\phi^{-}_{105,z}$ --.

Column 5, line 41, "$(_{105}-)$" should be -- $(\bar{}_{105})$ --.

Column 5, line 42, "$(_{105}-)$; should be -- $(\bar{}_{105})$ --.

Column 6, replace the formula at lines 1-5 with:

$$BOS = (1 - \frac{\ell}{\ell_o}) \; X \; 100$$

UNITED STATES PATENT AND TRADEMARK OFFICE

CERTIFICATE OF CORRECTION

PATENT NO. : 5,171,504

DATED : December 15, 1992

INVENTOR(S) : Cuculo et al.

It is certified that error appears in the above-identified patent and that said Letters Patent is hereby corrected as shown below:

Column 6, line 6, replace "l·" with -- $\ell$. -- and also in line 6 replace "l" with -- $\ell$ --.

Column 14, line 4, "filaments" should be -- filament --.

Column 14, line 17, Table 4, replace the heading "$L_{105}$-" with -- $L_{105}^{-}$ --

Column 14, line 18, Table 4, replace the heading "$f_c$" with -- $f_c$ -- and replace the heading "$f_{am}$" with -- $f_{am}$ --.

Signed and Sealed this

Twenty-third Day of November, 1993

*Attest:*

*Attesting Officer*

Bruce Lehman

BRUCE LEHMAN

*Commissioner of Patents and Trademarks*